US011542047B2

(12) United States Patent
Parrucci

(10) Patent No.: US 11,542,047 B2
(45) Date of Patent: Jan. 3, 2023

(54) MACHINE FOR MAKING A COMPOSED PALLETIZED LOAD

(71) Applicant: AETNA GROUP S.P.A., Verucchio (IT)

(72) Inventor: Alessandro Parrucci, Verucchio (IT)

(73) Assignee: AETNA GROUP S.P.A., Verucchio (IT)

( * ) Notice: Subject to any disclaimer, the term of this patent is extended or adjusted under 35 U.S.C. 154(b) by 0 days.

(21) Appl. No.: 17/052,976

(22) PCT Filed: May 10, 2019

(86) PCT No.: PCT/IB2019/053890
§ 371 (c)(1),
(2) Date: Nov. 4, 2020

(87) PCT Pub. No.: WO2019/220292
PCT Pub. Date: Nov. 21, 2019

(65) Prior Publication Data

US 2021/0070483 A1 Mar. 11, 2021

(30) Foreign Application Priority Data

May 14, 2018 (IT) ..... 102018000005364

(51) Int. Cl.
*B65B 11/58* (2006.01)
*B65B 11/02* (2006.01)
(Continued)

(52) U.S. Cl.
CPC ..... *B65B 11/585* (2013.01); *B65B 11/025* (2013.01); *B65B 35/30* (2013.01); *B65B 41/12* (2013.01)

(58) Field of Classification Search
USPC ..... 53/147
See application file for complete search history.

(56) References Cited

U.S. PATENT DOCUMENTS 3,896,604 A * 7/1975 Marantz ..... B65D 71/08 53/176
4,499,706 A 2/1985 Scheller
(Continued)

FOREIGN PATENT DOCUMENTS

WO 2008/075144 6/2008
WO 2012/140568 10/2012

OTHER PUBLICATIONS

International Search Report dated Jul. 16, 2019 in International (PCT) Application No. PCT/IB2019/053890.

*Primary Examiner* — Chinyere J Rushing-Tucker
(74) *Attorney, Agent, or Firm* — Wenderoth, Lind & Ponack, L.L.P.

(57) ABSTRACT

A wrapping machine for making a composed palletized load made by a plurality of partial palletized loads wrapped with a plastic film, comprises a first operating station to individually and separately wrap the partial palletized loads with the film, a conveyor assembly to move along an advancing direction the partial palletized loads inside, towards and outside from the first operating station, a second operating station to arrange the plurality of partial palletized loads in a grouped configuration, in which they are adjacent and placed side by side, and then joint the plurality of partial palletized loads by an adhesive film in order to make the composed palletized load.

21 Claims, 4 Drawing Sheets

(51) Int. Cl.
*B65B 35/30* (2006.01)
*B65B 41/12* (2006.01)

(56) References Cited

U.S. PATENT DOCUMENTS

| | | | | |
|---|---|---|---|---|
| 5,491,956 | A * | 2/1996 | Donnelly | B65B 11/025 53/399 |
| 2014/0033657 | A1* | 2/2014 | Cere' | B65B 11/00 53/461 |
| 2020/0324926 | A1* | 10/2020 | Napravnik | B65B 35/58 |

* cited by examiner

MACHINE FOR MAKING A COMPOSED PALLETIZED LOAD

The invention relates to machines for wrapping a load with a film or wrap of stretchable plastic material and in particular relates to a machine for making a composed palletized load by grouping and joining a plurality of individual, partial palletized loads wrapped with plastic film. The invention also relates to a composed palletized load made in this manner.

The known wrapping machines are typically used to wrap with a series of straps or bands of plastic film a so-called palletized load, i.e. formed by a plurality of products, objects, packages grouped and arranged, generally in superimposed layers, on a pallet, also called a platform or palette.

The plastic film, suitably prestretched and wrapped around the products and the pallet with a determined wrapping force, allows not only protecting the products from dust, water, moisture, etc. but also and above all blocking them together and therefore stabilizing the load, allowing its movement and transport without the risk of damage or breakage.

The known wrapping machines comprise an unwrapping unit that supports a reel from which the film is unwrapped so as to be wrapped around the load in such a way as to form a series of straps or bands having a helical trend, thanks to the combination of the relative linear and rotational movements between the unwrapping unit and the load.

In wrapping machines provided with a rotary table for supporting the load, the latter is rotated about a vertical wrapping axis, while the unwrapping unit is vertically moved with reciprocated motion along a fixed column of the machine.

In wrapping machines equipped with a horizontal rotating ring or a rotating arm, the load remains fixed during wrapping, while the unwrapping unit is moved in relation to the latter both by rotating around a vertical wrapping axis and moving along the latter. For this purpose, the unwrapping unit is fixed to a ring structure or to an arm rotatably supported by the frame of the machine so as to rotate around the load. In particular, in wrapping machines with a horizontal ring, the unwrapping unit is fixed to the ring structure, or rotating ring, which is rotatably supported by a handling frame or carriage so as to rotate about a vertical wrapping axis. The handling carriage is in turn slidably fixed to a fixed frame of the wrapping machine so as to move parallel to the vertical wrapping axis. In wrapping machines with a rotating arm, the wrapping unit is slidably fixed to the arm in such a way as to be moved linearly along the latter, parallel to the wrapping axis. Then, in both types of machines, the film unwrapping apparatus is movable along, and around, the wrapping axis while the load to be wrapped remains fixed.

The unwrapping unit is generally equipped with a pair of prestretching rollers, comprising a slow roller and a fast roller, respectively upstream and downstream with reference to the movement of the film, in order to stretch and unwrap the stretchable film, and one or more diverting or return rollers to divert the film towards the load during unwrapping.

The known and most widely used pallets have standardized dimensions: in Europe the so-called European pallet is widespread and has plan dimensions of 800×1200 mm; in the United States the most common pallet has the dimensions 40×48 inches (about 1000×1200 mm); in Asia the most common pallet has the dimensions 1100×1100 mm.

These pallets are regardless cumbersome and not well-suited for the grouping and packaging of small groups or batches of products or packages. In fact, there is a known and increasingly perceived need for so-called flexible modular systems and equipment for the storage and distribution of goods which can make partial palletized loads, typically mixed loads composed of a plurality of different products or packages to be grouped and joined together to form a composed or fractionated palletized load. In this way, the composed load can be transported up to an intermediate destination (for example a distribution or sorting centre) wherein it is broken down to allow sending individual partial loads towards respective final destinations (e.g. sales centres).

For this purpose pallets are used for the partial palletized loads obtained by the division or fractionation of "whole" pallets, i.e. the "half" pallet, having the dimensions 800×600 mm in the case of a "half" European pallet, or a "quarter" pallet, with the dimensions 400×600 mm in the case of a "quarter" European pallet. In this way, the partial loads made on "half" or "quarter" pallets can be joined together in groups of two or four units respectively, so as to form a composed load having the dimensions of the whole pallet.

Each partial load is made by suitably wrapping with a plastic film the products that compose it. Similarly, the composed load is made by grouping two or four partial loads and wrapping them with the plastic film.

The wrapping procedure is therefore particularly laborious and lengthy in the case in which there is a single wrapping machine or apparatus, since the latter must first wrap the partial loads individually and then the loads grouped together. Operators and moving systems are also required to move the partial and composed loads inside and outside the wrapping machine.

There are also known and provided plants that comprise two or more wrapping machines or apparatuses connected between them by conveyors to perform the simultaneous wrapping of partial loads and composed loads in an automatic manner. These plants are however bulky and expensive in that they require multiple wrapping apparatuses.

One object of the invention is to improve the known systems and machines for making and wrapping composed loads consisting of a plurality of partial loads.

Another object is to provide a wrapping machine that allows producing composed palletized loads in a quick, simple and low-cost manner by grouping and connecting together a plurality of partial palletized loads after individually and separately wrapping the same with plastic film.

A further object is to provide a wrapping machine that is compact, of reduced dimensions, low-cost and having fully automated operation.

Yet another object is to provide a composed palletized load formed by a plurality of partial palletized loads wrapped with plastic film, that is stable, secure and robust even if moved and/or transported.

In a first aspect of the invention, a wrapping machine is provided according to claim 1.

In a second aspect of the invention, a composed palletized load is provided according to claim 11.

The invention can be better understood and implemented with reference to the attached drawings that illustrate an embodiment, by way of non-limiting example, in which.

Figure 1:
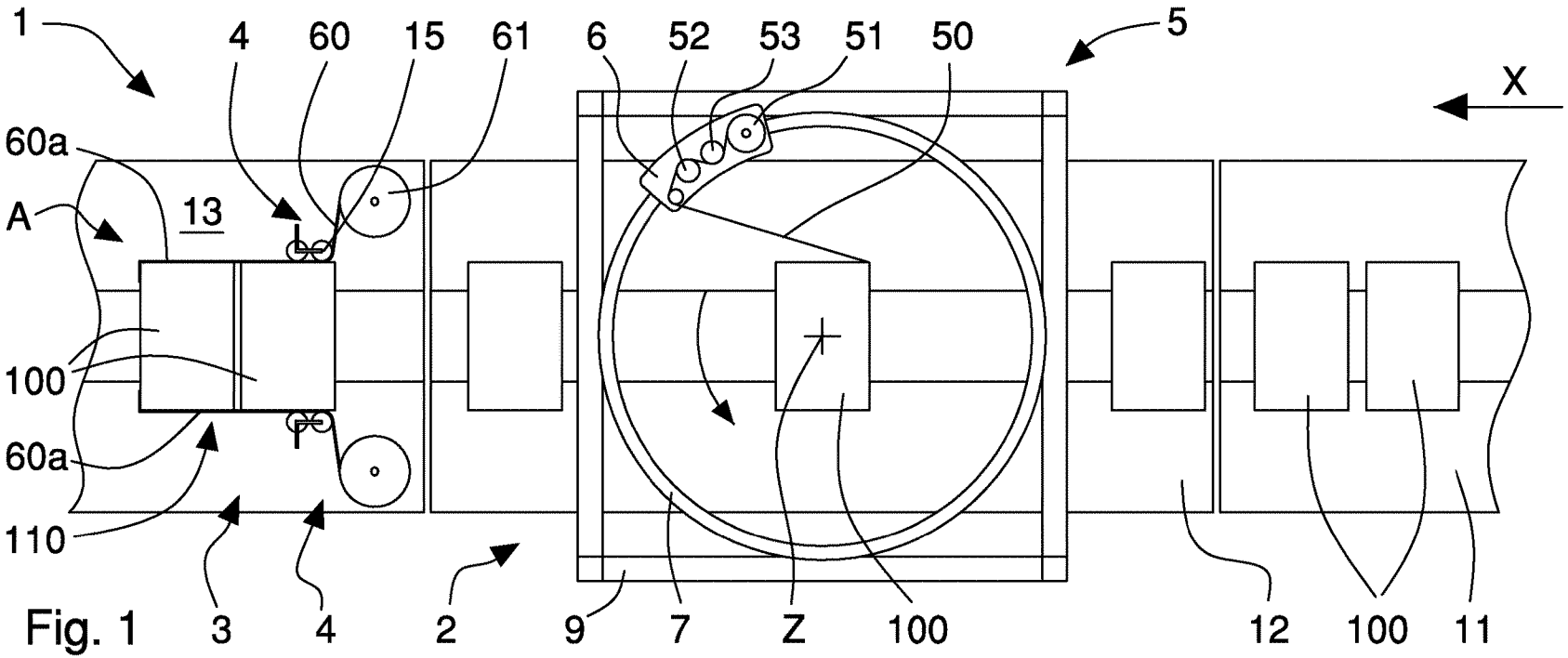
FIG. 1 is a schematic plan view of the wrapping machine according to the invention, associated with partial and composed loads to be wrapped.
Figure 2:
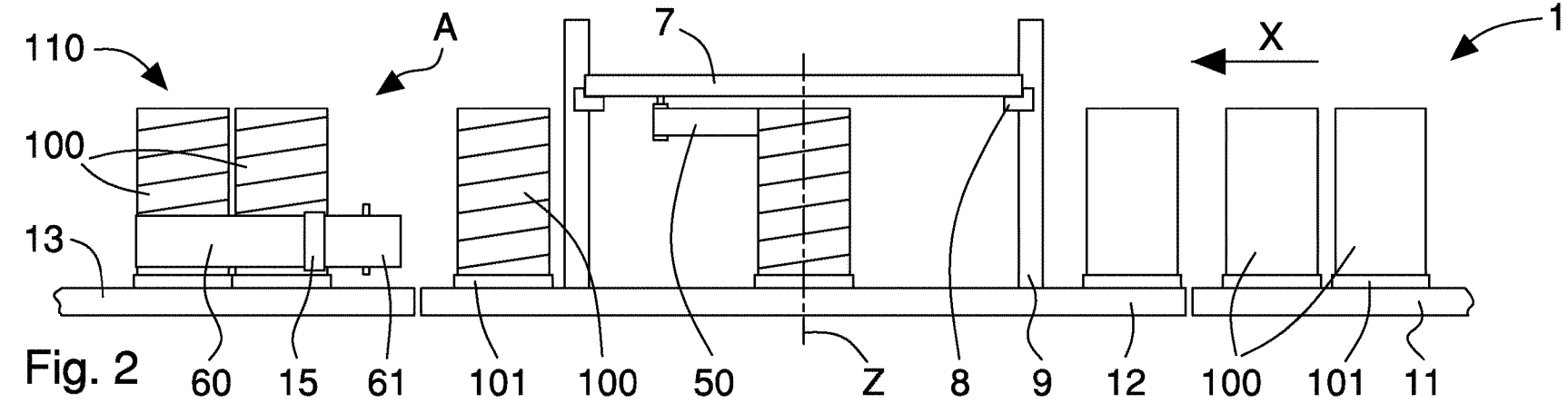
FIG. 2 is a side view of the wrapping machine of FIG. 1.

With reference to FIGS. 1 and 2, a wrapping machine 1 according to the invention is schematically shown, arranged to make a composed palletized load or composed load 110 comprising a plurality of partial palletized loads or partial loads 100, each of which is separately wrapped with a plastic film 50, in particular a stretchable plastic film.

The wrapping machine 1 comprises a first operating station 2 to individually and separately wrap the partial loads 100 with the film 50, a conveyor assembly 11, 12, 13 to move along an advancing direction×the partial loads 100 inside, through and outside the first operating station 2, and a second operating station 3 for grouping, in particular arranging said plurality of partial palletized loads 100 in a grouped configuration A, wherein they are adjacent and arranged side by side, and then join the plurality of partial loads 100 with an adhesive film 60 so as to make a composed load 110. The second operating station 3 is located downstream of the first operating station 2 with reference to the advancing direction X of the partial loads 100.

The first operating station 2 comprises a wrapping apparatus 5 provided with an unwrapping unit 6 and a moving system 7, 8 to rotate said first operating station 2 or each partial palletized load 100 around a wrapping axis Z, in particular almost vertical. The unwrapping unit 6 is provided with a film reel 51 and at least a couple of prestretching rollers 52, 53 to unwrap and stretch or lengthen the film 50 which is thus wrapped on the partial loads 100.

In the illustrated embodiment, the wrapping apparatus 5 is of the horizontal rotating ring type and the moving system comprise a ring 7 which rotates around the wrapping axis Z and supports the unwrapping unit 6. The moving system also comprise a supporting carriage 8 which supports the ring 7 and is movable parallel to the wrapping axis Z which is in turn supported by a main frame 9 of the wrapping machine 1. In this way, when a partial load 100 arrives inside a work area W of the first operating station 2, it is wrapped with a defined series of straps or bands of film 50 having a helical trend, thanks to the combination of linear and rotating movements of the unwrapping unit 6 along and around the wrapping axis Z.

Alternatively, the wrapping apparatus 5 can be provided with a moving system, comprising an arm rotating around a wrapping axis Z and slidably supporting the unwrapping unit 6, movable parallel to the wrapping axis Z.

Still alternatively, the unwrapping apparatus can be provided with a moving system comprising a rotating platform that supports and sets the partial load 100 in rotation around the wrapping axis Z, while the unwrapping unit 6 is movable along a supporting column fixed parallel to the wrapping axis Z.

Still alternatively, the wrapping apparatus 5 can be composed of a heat-shrinkable hooding unit or stretchable film hooding unit.

The second operating station 3 comprises at least one supplying unit 4 arranged to apply a portion 60*a* with defined length of adhesive film 60 around the partial loads 100 arranged grouped in the grouped configuration A, in which they are adjacent and side by side, so as to wrap them and block them together, thus forming a composed load 110. In the embodiment illustrated in the figures, the second operating station 3 comprises a pair of supplying units 4 arranged to face each other and opposite with respect to the advancing direction X so as to apply the respective portions 60*a* with defined length of adhesive film 60 around the partial loads 100 arranged in the grouped configuration A, as better explained in the following description.

In particular, each supplying unit 4 applies the respective portion 60*a* of adhesive film 60 to lower sections of the outer walls of the partial loads 100 at the respective supporting pallet 101 of the aforesaid partial loads. For this purpose, each supplying unit 4 comprises a reel 61 of adhesive film 60 and an applying device 15 to unwrap from the reel and apply to the partial palletized loads 100 the portion 60*a* with a defined length of adhesive film 60. The applying device 15, of known type and not shown in detail in the figures, comprise for example a couple of applicator rollers and a cutting and tensioning system of the adhesive film. The adhesive film 60 has, for example, a band height or width comprised between 300 and 1000 mm, and preferably equal to 600 mm, and a thickness comprised between 15 and 50 μm, and preferably 40 μm. The adhesive film 60 is, for example, an adhesive film of biaxially-oriented polypropylene (BOPP), of known type and commercially available, that exhibits good rigidity and high tensile strength and in particular, a plastic material which is substantially impossible to extend or stretch, unlike the plastic film 50. Other types of adhesive tapes/films which have equivalent or higher physical, mechanical performance can also be used to wrap and block the partial palletized loads.

Figure 3:
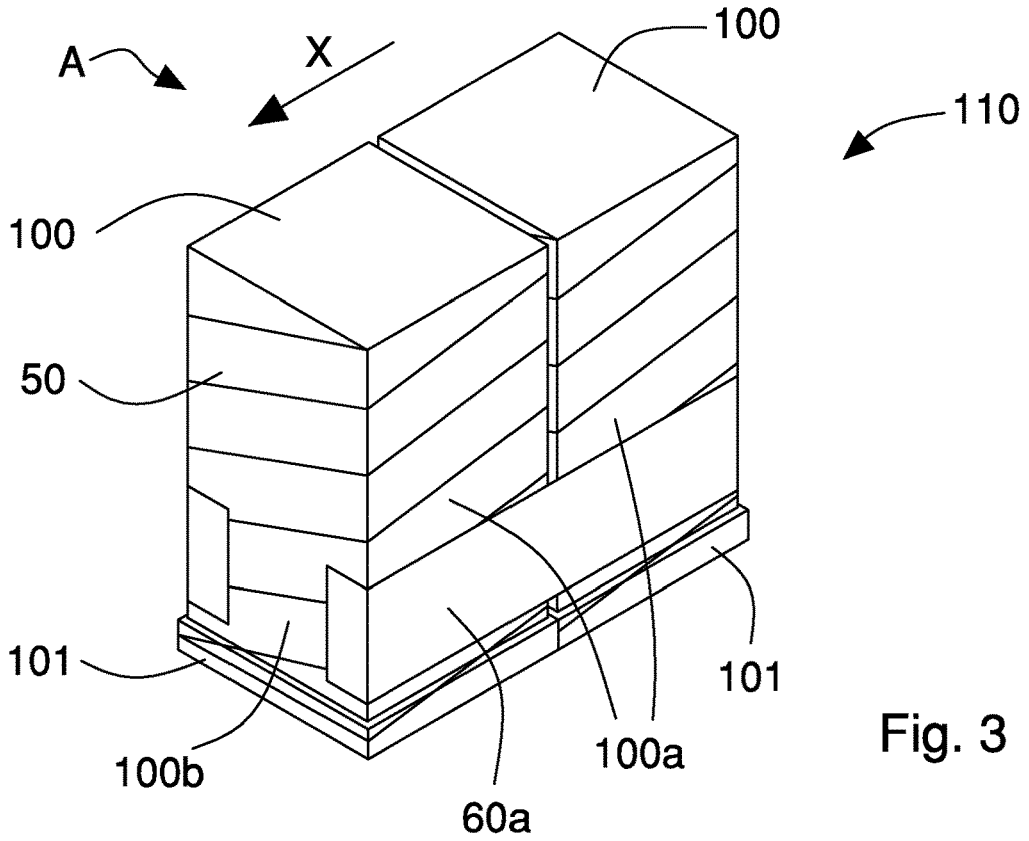
FIG. 3 is a perspective view of a composed palletized load made by the wrapping machine of FIG. 1.

In the embodiment illustrated in FIGS. 1 and 2 the wrapping machine 1 of the invention is arranged to make a composed palletized load 110 comprising a couple of partial palletized loads 100 arranged aligned and side by side, joined by two portions 60*a* of adhesive film 60 applied so as to wrap the external walls 100*a*, 100*b* of the partial palletized loads 100. More precisely, as shown in particular in FIG. 3, each portion 60*a* of adhesive film 60 adheres with its median section to the respective longitudinal external walls 100*a* (i.e. parallel to the advancing direction X), adjacent to and substantially coplanar with the two partial loads 100. Opposite end flaps of each portion 60*a* of adhesive film adhere instead to opposite transverse external walls 100*b* (i.e. orthogonal to the advancing direction X) of the two partial loads 100. The portions 60*a* of adhesive film 60 adhere to the partial loads, forming elements which retain and block the composed loads 110 both longitudinally and transversely, i.e. both parallel and orthogonal to the advancing direction X. It should be noted that the length of the two portions 60*a* of adhesive film 60 is calculated so as to ensure the maximum strength and robustness to the junction (the two portions of adhesive film 60 are not extensible or stretchable) and at the same time so as to limit the consumption of adhesive film 60 to limit the packaging costs of the composed load 110.

The partial loads 100 are preferably formed by placing the products on respective pallets 101 of the so-called "half" pallet type, for example a standard half pallet with dimensions equal to half that of a standard supporting pallet, in particular a European pallet, i.e. equal to 800×600 mm. In this way, the partial loads 100, once joined in couples with the adhesive film 60, form a composed load that has dimensions equal to those of a whole pallet, i.e. with the dimensions 800×1200 mm in the case of a European pallet.

The wrapping machine 1 also includes a conveyor assembly 11, 12, 13 to move along the advancing direction X the partial palletized loads 100 inside, through and outside the first operating station 2. In particular the conveyor assembly comprise a first conveyor 11, a second conveyor 12 and a third conveyor 13, each of which is constituted for example by a roller conveyor or the like. The first conveyor 11 moves the individual partial loads 100 to be wrapped with the film 50 along the advancing direction X towards the first operating station 2. The second conveyor 12 receives partial loads 100 from the first conveyor 11 and moves them through the first operating station 2, in particular towards, and from, the work area W wherein the wrapping apparatus 5 separately and individually wraps each partial load 100 with the film 50. The third conveyor 13 receives the partial loads 100 wrapped with the film 50 from the second conveyor 12 and moves them, bringing them closer and compacting them in the grouped configuration A, towards and through the second operating station 3, for the application of the adhesive film 60 and the formation of the composed load 110.

The operation of the wrapping machine 1 of the invention provides for the movement of the individual partial loads 100 through the conveyor assembly 11, 12, 13 towards the first operating station 2. In particular, the first conveyor 11 individually moves and transfers each partial load 100 to the second conveyor 12 that moves the latter at the wrapping apparatus 5 in the work area W wherein the aforesaid partial load 100 is wrapped with the film 50.

Once the wrappping is completed, the wrapped partial load 100 is transferred from the second conveyor 12 to the third conveyor 13. At the same time, the second conveyor 12 moves a partial load 100 to be wrapped, received from the first conveyor 11 in the work area W. The third conveyor 13 is actuated so as to bring closer and to compact into the grouped configuration A the two partial loads 100 intended to form the composed load 110. Correctly brought closer, the two partial loads are moved from the third conveyor 13 along the advancing direction X through the second operating station 3 in which the supplying unit 4 applies the portions 60*a* of adhesive film 60 so as to make the composed load 110.

In particular, each supplying unit 4 applies a portion 60*a* of adhesive film 60 which adheres to the adjacent and substantially coplanar longitudinal external walls 100*a* of the two partial loads 100 and at the opposite transverse external walls 100*b* of the two partial loads 100. Thanks to the wrapping machine 1 of the invention it is therefore possible to make composed palletized loads 110 in a quick, simple and low-cost manner by grouping and connecting together a plurality of partial palletized loads 100 after individually and separately wrapping the same with a plastic film 50. In particular, using one or more specific supplying units 4 that apply portions 60*a* of adhesive film 60 of suitable length to partial palletized loads 100, the wrapping machine 1 is low-cost and, compact and of reduced dimensions and has fully automated operation that ensures high productivity.

In fact, it should be noted that the wrapping machine 1 of the invention does not require an expensive and bulky second wrapping apparatus for wrapping the composed load with stretchable plastic film. It is also not alternatively necessary that the composed load be wrapped with the film by the single wrapping apparatus, thereby increasing the duration of the cycle for making the load and consequently reducing the productivity of the wrapping machine.

Tests carried out by the Applicant have also shown that the composed palletized load 110 formed by the plurality of partial palletized loads joined and blocked by the two portions 60*a* of adhesive film 60 is stable, secure and robust even if moved and/or transported, at the same level as composed loads wrapped by a plurality of twisted bands of plastic film.

Figure 7:
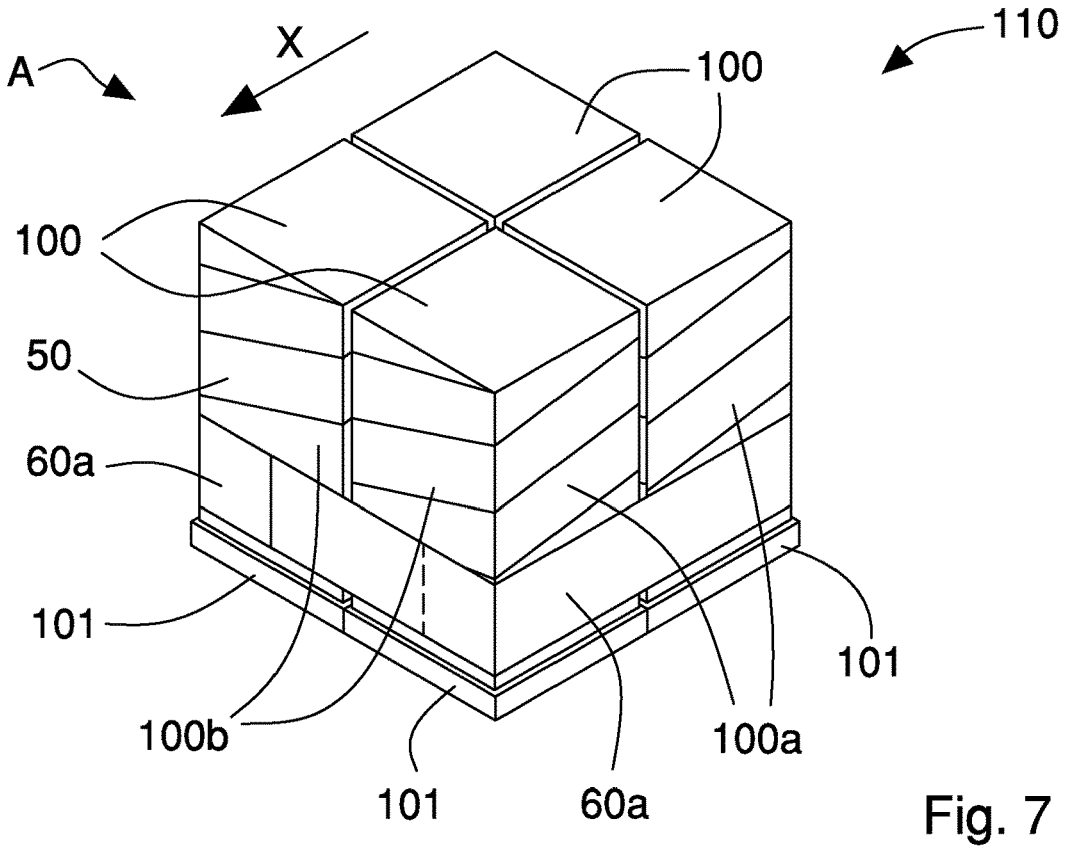
FIG. 7 is a perspective view of the composed palletized load of FIG. 6.
Figure 4:
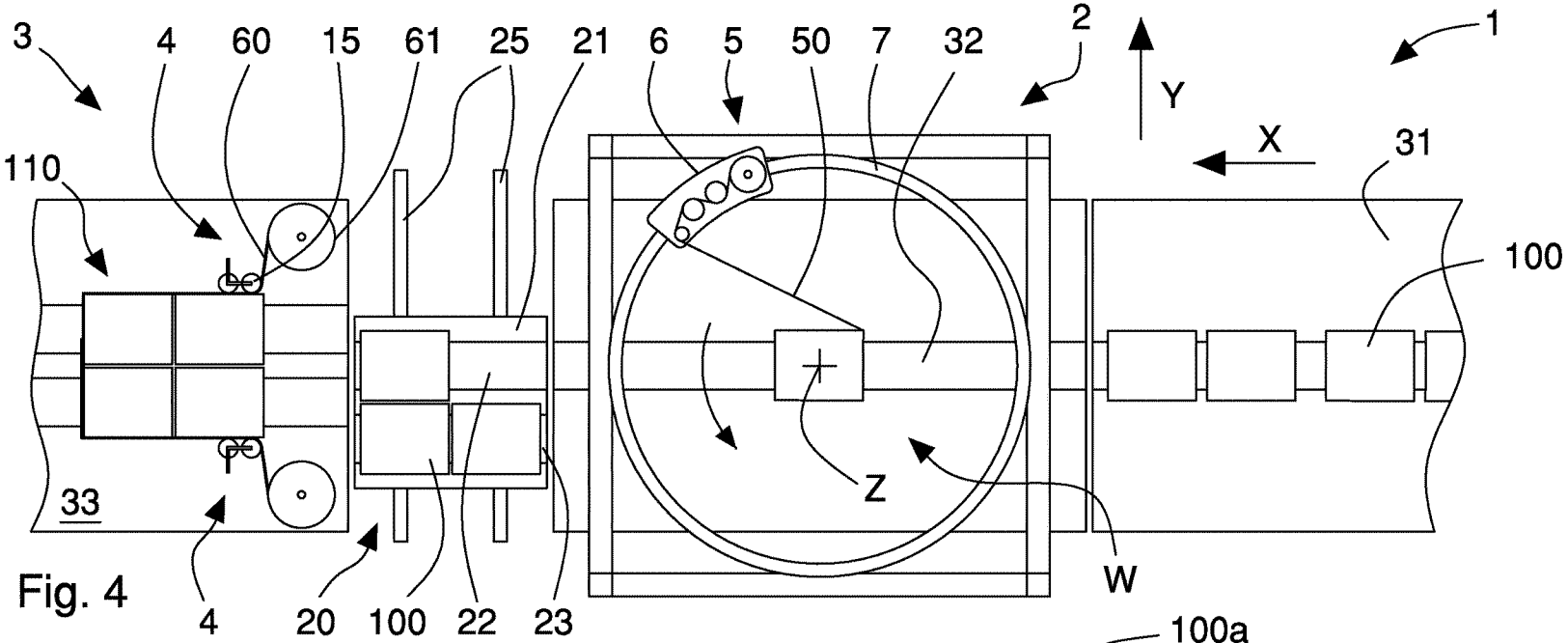
FIG. 4 is a schematic plan view of a variant of the wrapping machine according to the invention.
Figure 5:
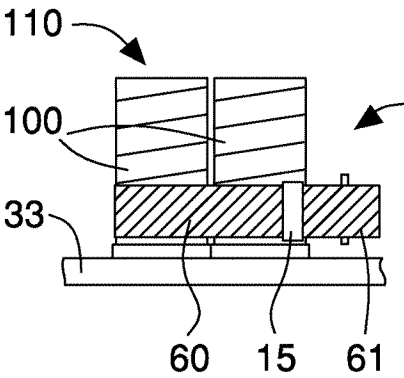
FIG. 5 is a partial side view of the wrapping machine of FIG. 4.
Figure 6:
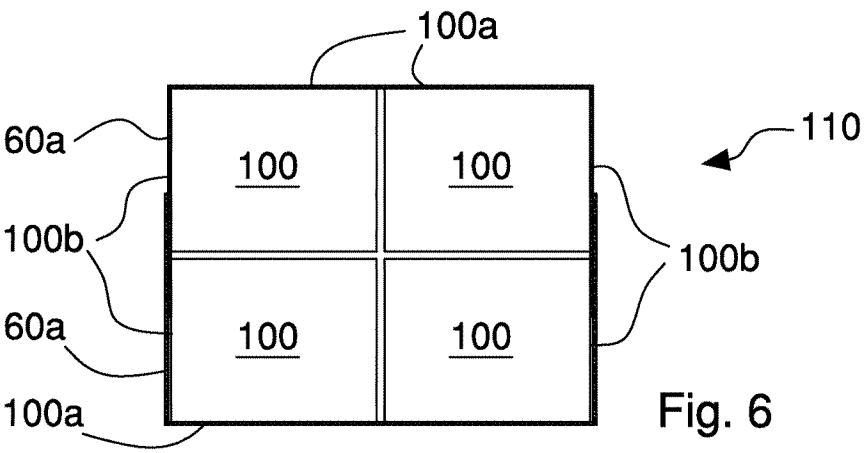
FIG. 6 is a plan view of a composed palletized load made by the wrapping machine of FIG. 4.

FIGS. 4 and 5 illustrate a variant of the wrapping machine 1 arranged to make a composed palletized load 110 formed by four partial palletized loads 100 arranged side by side in two parallel rows and joined by two portions of adhesive film 60 applied so as to wrap the external walls of the aforesaid partial palletized loads 100, in particular by adhering to lower sections of the aforesaid external walls 100*a*, 100*b* at the respective supporting pallet 101. More precisely, and with particular reference to FIGS. 6 and 7, each portion of adhesive film 60 adheres with its median section to the longitudinal external walls 100*a* (parallel to the advancing direction X), adjacent and substantially coplanar and to the transverse and opposite external walls 100*b* (orthogonal to the advancing direction X) of two partial loads 100 aligned along the advancing direction X. Opposite end flaps of each portion of adhesive film adhere instead to the opposite transverse external walls 100*b* (i.e. orthogonal to the advancing direction X) of the other two partial loads 100 aligned along the advancing direction X. The terminal flaps of a portion 60*a* of adhesive film overlap with those of the other portion 60*a* to substantially form a ring of adhesive film which fully surrounds the composed load 110, holding and blocking the four partial loads 100 parallel and orthogonally to the advancing direction X.

Also in this case the length of the two portions 60*a* of adhesive film 60 is calculated so as to ensure the maximum strength and robustness to the junction and at the same time so as to limit the consumption of adhesive film 60 to contain the packaging costs of the composed load 110.

The partial palletized loads 100 are preferably formed by placing products on respective pallets 101 of the so-called "quarter" pallet type, for example a standard quarter pallet with dimensions equal to a quarter that of a standard supporting pallet, in particular a European pallet, i.e. equal to 400×600 mm. In this way, four partial palletized loads 100, once joined side by side in two parallel rows and fixed together with the adhesive film 60, form a composed palletized load 110 that has dimensions equal to those of a whole pallet i.e. with the dimensions 800×1200 mm in the case of a European pallet.

This variant of the wrapping machine 1 differs from the embodiment previously illustrated in that the second operating station 3 comprises a grouping apparatus 20 interposed between the first operating station 2 and the supplying unit 4 and arranged to receive one by one from the first operating station 2 the palletized loads 100 wrapped with the film 50, arrange the latter side by side in two parallel rows in the grouped configuration A and then transfer them to at least one of the supplying units 4 of the second operating station 3 in which the portions 60*a* of adhesive film 60 are applied.

The grouping apparatus 20 comprises a platform 21 which is movable along an approaching direction Y almost orthogonal to the advancing direction X and which supports at least two conveyors 22, 23 arranged side by side and parallel to the advancing direction X to receive and move the partial palletized loads 100. The platform 10 is slidably mounted on sliding guides 25.

The grouping apparatus 20 is interposed between the second conveyor 32 and the third conveyor 33, the latter being arranged to move partial loads 100 arranged in two rows adjacent and parallel to the advancing direction X.

The operation of this variant of the wrapping machine 1 provides for the supply of partial loads 100 and their wrapping in the first operating station 2 according to the methods previously described for the wrapping machine of FIGS. 1 and 2. Differently, the individual partial loads 100 output from the first operating station 2 are transferred from the second conveyor 32 to the grouping apparatus 20 to be arranged in the grouped configuration A. More precisely, the platform 21 of the grouping apparatus 20 is moved along the approaching direction Y in a first receiving position in which the first conveyor 22 is aligned with the second conveyor 12 so as to receive from the first operating station 2 two partial loads 100 wrapped with the film 50 in succession by the wrapping apparatus 5. The two partial loads 100 are positioned on the first conveyor 22 aligned along the advancing direction X and adjacent to the respective supporting pallet 101 in mutual contact along the approaching direction Y.

The platform 21 is then moved in a second receiving position in which the second conveyor 23 is aligned with the second conveyor 32 so as to receive from the first operating station 2 two further partial loads 100 wrapped with the film 50 in succession by the wrapping apparatus 5. The two partial loads 100 are positioned on the second conveyor 23 aligned along the advancing direction X and adjacent to the respective supporting pallet 101 in mutual contact along the approaching direction Y. The distance between the first conveyor 22 and the second conveyor 23 is such as to arrange the two pairs of partial loads 100 adjacent and side by side with the respective supporting pallet 101 in mutual contact along the advancing direction X and the approaching direction Y.

The platform 21 is then moved to a transfer position in which the first conveyor 22 and the second conveyor 23 are aligned with the third conveyor 33 and transfer the partial loads 100, arranged in the grouped configuration A, to the third conveyor 33 which moves them toward the supplying units 4 for the application of the portions 60*a* of adhesive film 60.

Figure 8:
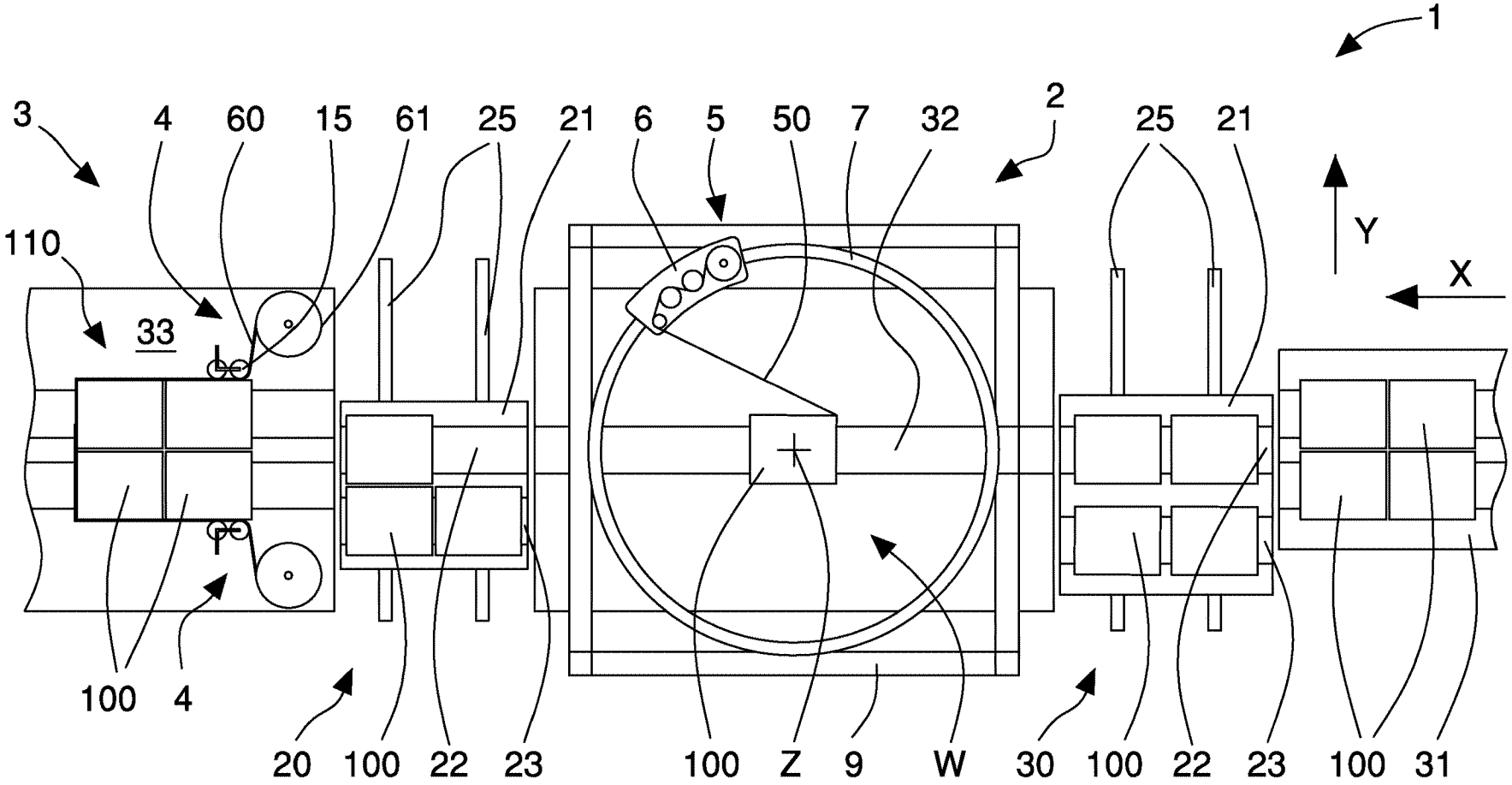
FIG. 8 is a plan view of another variant of the wrapping machine according to the invention.

FIG. 8 shows another variant of the wrapping machine 1 of the invention which differs from the embodiment described above and illustrated in FIGS. 4 and 5 in that it comprises a separating apparatus 30 arranged upstream of the first operating station 2 with reference to the advancing direction X and arranged to receive from the conveyor assembly 31, 32, 33 partial palletized loads 100 to be wrapped with the film 50 and arranged grouped, adjacent and side by side, and then transfer them one by one to the first operating station 2. More precisely, the separating apparatus 30 receives from the first conveyor 31, suitably sized, two couples of partial loads 100 arranged grouped, adjacent and side by side in two rows, with the respective supporting pallets 101 in mutual contact along the advancing direction X and the approaching direction Y.

The partial pallets 100 come, for example, from a composing station in which products, objects, packages are arranged in superimposed layers on supporting pallets 101.

The separating apparatus 30 is identical to the grouping apparatus 20 and comprises a respective platform 21 movable along the approaching direction Y on sliding guides 25 and supporting two respective conveyors 22, 23 parallel to the advancing direction X and arranged to receive and move the partial loads 100.

The operation of this variant of the wrapping machine 1 differs from that of the machine of FIGS. 4 and 5 in that it provides for the use of the separating apparatus 30 to separate and individually introduce the partial loads 100 in the first operating station 2. More precisely, the platform 21 of the separating apparatus 30 is moved along the approaching direction Y in a receiving position in which the first conveyor 22 and the second conveyor 23 are aligned with the first conveyor 31 so as to receive from the latter the two pairs of partial loads 100 grouped together and in mutual contact along the advancing direction X and approaching direction Y. The platform 21 of the separating apparatus 30 is then moved to a first transfer position in which the first conveyor 22 is aligned with the second conveyor 32 to transfer to the first operating station 2 one by one the two partial loads 100 to be wrapped. Once the transfer is performed, the platform 21 of the separating apparatus 30 is moved to a second transfer position in which the second conveyor 23 is aligned with the second conveyor 32 to individually transfer to the first operating station 2 the other two partial loads 100 to be wrapped.

The invention claimed is:

1. A wrapping machine for making a composed palletized load comprising a plurality of partial palletized loads wrapped with a plastic film, the wrapping machine comprising:

a first operating station to individually and separately wrap the partial palletized loads with the plastic film;

a conveyor assembly to move along an advancing direction the partial palletized loads inside, towards and outside from said first operating station; and a second operating station to arrange the plurality of partial palletized loads in a grouped configuration, in which they are adjacent and placed side by side, and then joint the plurality of partial palletized loads by an adhesive film in order to make the composed palletized load load, wherein said first operating station comprises a wrapping apparatus that is provided with an unwrapping unit and a moving system, said moving system being configured to rotate said unwrapping unit or one of the partial palletized loads about a wrapping axis, and said unwrapping unit being configured to wrap the one of the partial palletized loads with the plastic film while said moving system rotates said unwrapping unit or the one of the partial palletized loads about the wrapping axis, and wherein the second operating station comprises at least one supplying unit located downstream of said wrapping apparatus, said supplying unit applying the adhesive film to the plurality of partial palletized loads that have been separately wrapped with the plastic film while the plurality of partial palletized loads are moving in the advancing direction to make the composed palletized load.

2. The wrapping machine according to claim 1, wherein said at least one supplying unit is arranged to apply a portion with predefined length of the adhesive film around the partial palletized loads that are arranged in the grouped configuration.

3. The wrapping machine according to claim 2, wherein said at least one supplying unit is arranged to apply the portion of adhesive film to lower sections of external walls of the partial palletized loads at respective supporting pallets of the partial palletized loads.

4. The wrapping machine according to claim 2, wherein said at least one supplying unit comprises a reel of the adhesive film and an applying device to unwrap from the reel and apply to the partial palletized loads the portion of adhesive film.

5. The wrapping machine according to claim 2, wherein said at least one supplying unit is a plurality of supplying units that are arranged to apply respective portions with predefined length of the adhesive film around the partial palletized loads placed in the grouped configuration.

6. The wrapping machine according to claim 2, wherein said second operating station further comprises a grouping apparatus that is arranged to receive one by one from said first operating station the partial palletized loads wrapped with the plastic film, place the partial palletized loads in the grouped configuration and transfer the partial palletized loads to said at least one supplying unit that is arranged to apply a portion of the adhesive film with predefined length around the partial palletized loads.

7. The wrapping machine according to claim 2, further comprising a separating apparatus that is arranged upstream of said first operating station with reference to the advancing direction and is arranged to receive from said conveyor assembly the partial palletized loads to be wrapped with the plastic film and arranged grouped, adjacent and placed side by side, and to transfer one by one the partial palletized loads into said first operating station.

8. The wrapping machine according to claim 2, wherein said unwrapping unit is provided with a film reel and with a plurality of prestretching rollers to unwrap and prestretch the plastic film.

9. The wrapping machine according to claim 1, wherein said at least one supplying unit is a plurality of supplying units that are arranged to apply respective portions with predefined length of the adhesive film around the partial palletized loads placed in the grouped configuration.

10. The wrapping machine according to claim 1, wherein said second operating station further comprises a grouping apparatus that is arranged to receive one by one from said first operating station the partial palletized loads wrapped with the plastic film, place the partial palletized loads in the grouped configuration and transfer the partial palletized loads to said at least one supplying that is arranged to apply a portion of the adhesive film with predefined length around the partial palletized loads.

11. The wrapping machine according to claim 10, wherein said grouping apparatus comprises a platform that is movable along an approaching direction orthogonal to the advancing direction and supports at least two conveyors that are placed parallel to the advancing direction in order to receive and move the partial palletized loads.

12. The wrapping machine according to claim 1, further comprising a separating apparatus that is arranged upstream of said first operating station with reference to the advancing direction and is arranged to receive from said conveyor assembly the partial palletized loads to be wrapped with the plastic film and arranged grouped, adjacent and placed side by side, and to transfer one by one the partial palletized loads into said first operating station.

13. The wrapping machine according to claim 12, wherein said separating apparatus comprises a respective platform that is movable along an approaching direction orthogonal to the advancing direction and supports at least two respective conveyors that are parallel to the advancing direction and arranged to receive and move the partial palletized loads.

14. The wrapping machine according to claim 1, wherein said unwrapping unit is provided with a film reel and with a plurality of prestretching rollers to unwrap and prestretch the plastic film.

15. A composed palletized load comprising a plurality of partial palletized loads each of which is individually wrapped by a stretchable plastic film and placed side by side and adjacent in a grouped configuration, wherein the composed palletized load comprises two portions of substantially non-stretchable plastics adhesive film with predefined length that are applied around said partial palletized loads to wrap and mutually block said partial palletized loads in the grouped configuration, wherein said two portions of substantially non-stretchable plastics adhesive film are provided at a same height along an outer surface of the grouped configuration of said partial palletized loads.

16. The composed palletized load according to claim 15, wherein said plurality of partial palletized loads comprises a pair of partial palletized loads that are placed side by side and joined by said two portions of said adhesive film that is applied so as to wrap external walls of said pair of partial palletized loads.

17. The composed palletized load according to claim 15, wherein said plurality of partial palletized loads comprises a pair of partial palletized loads that are placed side by side and joined by said two portions of said adhesive film that is applied so as to wrap lower sections of external walls of said pair of partial palletized loads at respective supporting pallets.

18. The composed palletized load according to claim 17, wherein said supporting pallets have dimensions equal to half of those of a standard supporting pallet.

19. The composed palletized load according to claim 15, wherein said plurality of partial palletized loads comprises four partial palletized loads that are placed side by side in two parallel rows and joined by said two portions of said adhesive film that is applied so as to wrap external walls of said four partial palletized loads.

20. The composed palletized load according to claim 15, wherein said plurality of partial palletized loads comprises four partial palletized loads that are placed side by side in two parallel rows and joined by said two portions of said adhesive film that is applied so as to wrap lower sections of external walls of said four partial palletized loads at respective supporting pallets.

21. The composed palletized load according to claim 20, wherein said supporting pallets have dimensions equal to a quarter of those of a standard supporting pallet.

* * * * *